United States Patent [19]

Dodich

[11] 4,449,344

[45] May 22, 1984

[54] CEILING PANEL AND LENS

[75] Inventor: James Dodich, New Milford, N.J.

[73] Assignee: Levolor Lorentzen, Inc., Lyndhurst, N.J.

[21] Appl. No.: 336,572

[22] Filed: Jan. 4, 1982

[51] Int. Cl.[3] ..... E04B 5/57

[52] U.S. Cl. ..... 52/475

[58] Field of Search ..... 52/475, 823, 824, 826, 52/28, 475, 476; 40/575, 576, 490, 491, 611; 362/147, 150, 433, 455; 350/258

[56] References Cited

U.S. PATENT DOCUMENTS

| | | | |
|---|---|---|---|
| 1,633,785 | 6/1927 | Hotchner | 40/576 |
| 2,450,330 | 9/1948 | Degiers | 52/475 |
| 2,773,289 | 12/1956 | Martin et al. | 52/475 |
| 2,807,110 | 9/1957 | Buedingen | 52/475 |
| 3,383,811 | 5/1968 | Ades | 52/28 |
| 3,890,728 | 6/1975 | Schubert | 40/611 |
| 4,363,082 | 12/1982 | Roland | 362/148 |

FOREIGN PATENT DOCUMENTS

| | | | |
|---|---|---|---|
| 7901260 | 8/1980 | Netherlands | 52/28 |

*Primary Examiner*—James L. Ridgill, Jr.

[57] ABSTRACT

A ceiling panel having an elongated bottom face and an opening with opposite parallel edges, two moldings respectively having first portions engaging the edges and second portions spaced outwardly away from the portions and above the opening, and a lens placed on the moldings between the second portions, the lens being held in place by downwardly bent areas of the second portions while the moldings are held in place at the edges by the lens.

1 Claim, 7 Drawing Figures

CEILING PANEL AND LENS

BACKGROUND OF THE INVENTION

The present invention relates to a ceiling panel and more specifically to a combination of a sheet metal ceiling panel with a plastic lens and with means for holding the plastic lens in place in the ceiling panel.

Several forms of such combination are known in the art, as for instance described in U.S. Pat. No. 4,363,082, issued Dec. 7, 1982 and assigned to the same assignee.

Such ceiling panels may have various lengths and widths, but they are usually fifty inches long for a four foot light fixture and about three and one half or seven inches wide. The panel is slotted about 3 inches wide for a single-lamp fixture and wider for a double lamp fixture.

Cutting away long sections from the ceiling panel, such as approximately 46 to 48 inches, weakens the panel considerably since it has lost its rigid structure and is suspended only at two ends.

Also, if only a single light fixture is involved which requires a narrow slot in a wide ceiling panel, a considerable amount of lens material would be wasted if it were simply placed cross the entire width of the wide ceiling panel, that is it would have to be approximately 6½ inches wide of which only 3 inches would be visible.

It is, therefore, an object of the present invention to provide a ceiling panel with lens which will overcome the disadvantages described above.

BRIEF SUMMARY OF THE INVENTION

In order to stiffen the ceiling panel, stiffening flanges or moldings are formed from the material cut out from the ceiling panel, and they are placed along the edges of the ceiling panel opening and hold the lens in place.

BRIEF DESCRIPTION OF THE DRAWINGS

The invention as illustrated, by way of example, in the accompanying drawings, in which.

DETAILED DESCRIPTION OF PREFERRED EMBODIMENTS

Figure 1:
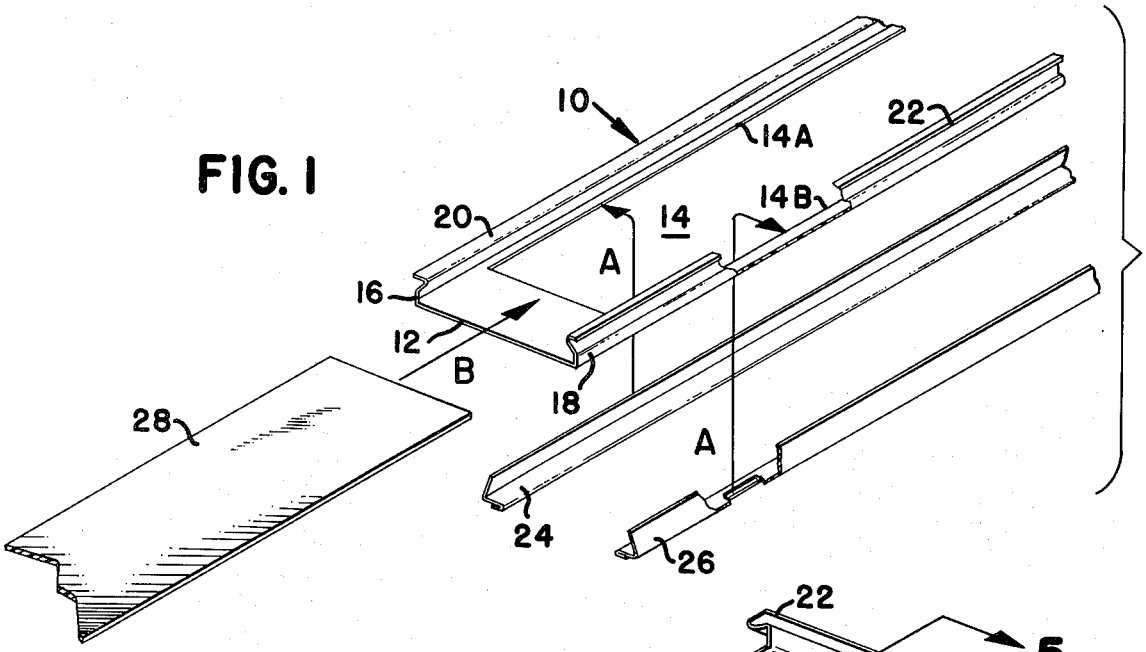
FIG. 1 is a partial perspective view of the combination of a ceiling panel, lens, and stiffening flanges according to the invention, prior to assembly.
Figure 3:
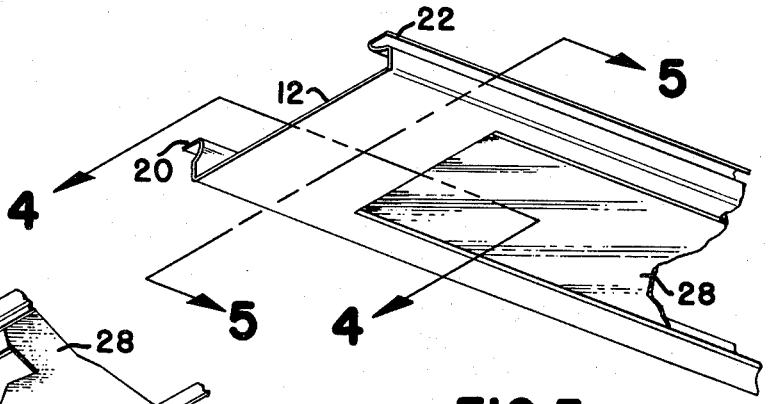
FIG. 3 is a perspective view, as seen from the bottom, of the assembled ceiling panel and lens.

Referring now to the drawings in detail, FIG. 1 shows a ceiling panel 10 having a bottom 12 from which a considerable portion has been removed, for instance by a punching process so as to leave a relatively long and wide cut-out 14. The ceiling panel also has side walls 16, 18 and flange portions 20,22 by which the ceiling panel is suspended from ceiling support structure (not shown). From the material of the cut-out portion of the ceiling panel two stiffening flanges or moldings 24 and 26 are formed which have a shape more clearly shown in FIGS. 5, 6 and 7. Finally, FIG. 1 shows a lens 28 which is to cover the cut-out, from inside the panel and is to be located below a lighting fixture (not shown) in the ceiling.

Figure 2:
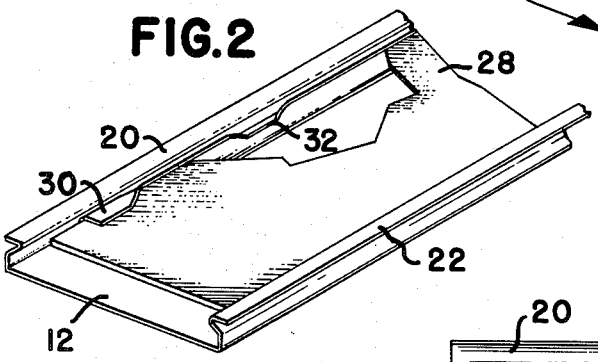
FIG. 2 is a perspective view as seen from the top of the assembly in finished form.
Figure 4:
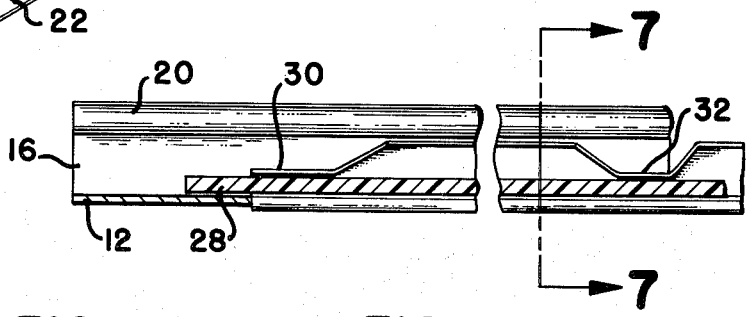
FIG. 4 is a section taken along the line 4—4 of FIG. 3.
Figure 7:
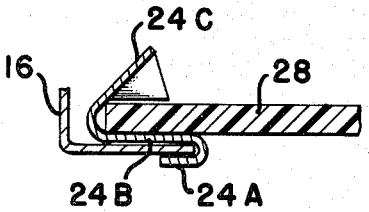
FIG. 7 is a section along the line 7—7 of FIG. 4.
Figure 5:
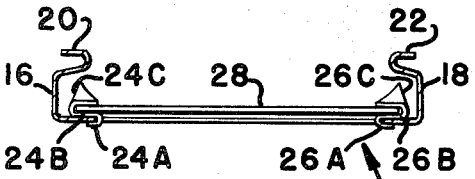
FIG. 5 is a section taken along the line 5—5 of FIG. 3.
Figure 6:
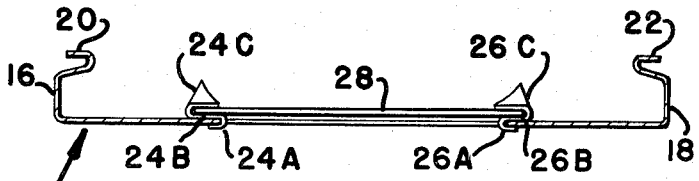
FIG. 6 is a section similar to that of FIG. 5, but of a modified ceiling panel and lens assembly.

As will be seen from FIGS. 5, 6 and 7 the two stiffening flanges or moldings 24,26 are each essentially S-shaped, with a first relatively narrow portion *24a*,*26a* respectively, and a relatively wide central portion *24b*, *26b*, respectively, and another relatively wide portion *24c*, *26c*. The moldings 24,26 are slipped over the internal edges *14a*, *14b*, respectively of the ceiling panel, as indicated by arrows A. Thereafter, the lens 28 is moved from one end of the panel on top of portions *24b*,*26b*, as indicated by arrow B (FIG. 1). Portions *24c*,*26c*, respectively are then bent down over outer edges of the lens 28 at spaced locations along the length of the stiffening flanges, as indicated by positions 30 and 32 in FIGS. 2 and 4.

The embodiment of FIG. 6 shows that the same width lens 28 can also be used in a wider ceiling panel *10a* (compared to ceiling panel 10). The reverse arrangement is also contemplated by the invention, namely to use wider lenses (for instance for a two-lamp light fixture) in the same size ceiling panel.

As will be evident from the above, the two S-shaped moldings stiffen the panel, keep the lens in place, while in turn the lens keeps the two moldings in place against the edges of the panel.

I claim:

1. For use in a suspended ceiling: an elongated ceiling panel having elongated flanges for suspending said ceiling panel, and an elongated bottom integral with said flanges, an elongated opening in said bottom extending over a substantial portion of said bottom and being defined by elongated parallel edges in said bottom; two elongated moldings respectively located along said elongated parallel edges and having essentially the same length as said edges, each molding being essentially S-shaped in cross section and in cross section having a relatively narrow first portion below said bottom, a second portion parallel to and wider than the said first portion and located above said bottom, said second portion being integral with said first portion and connected thereto by a portion placed around the respective edge, and a third portion spaced outwardly away from said opening and located above said bottom; and an elongated lens wider than said opening and slidably received in said panel between said third portions of said two moldings, said lens being supported by said second portions of said two moldings and being held onto said panel by spaced downwardly bent areas of said third portions of said two moldings, said moldings in turn being held against said edges by said lens.

* * * * *